US008241052B2

(12) United States Patent
Mulot et al.

(10) Patent No.: US 8,241,052 B2
(45) Date of Patent: Aug. 14, 2012

(54) ELECTRICAL CONNECTOR SYSTEM WITH POWER AND COMMAND CONNECTORS

(75) Inventors: Gérard Mulot, Nogent le Roi (FR); Claude Casses, Clevilliers (FR)

(73) Assignee: FCI Automotive Holding, Guyancourt (FR)

( * ) Notice: Subject to any disclaimer, the term of this patent is extended or adjusted under 35 U.S.C. 154(b) by 41 days.

(21) Appl. No.: 12/735,644

(22) PCT Filed: Feb. 22, 2008

(86) PCT No.: PCT/IB2008/001322

§ 371 (c)(1),
(2), (4) Date: Aug. 4, 2010

(87) PCT Pub. No.: WO2009/104044

PCT Pub. Date: Aug. 27, 2009

(65) Prior Publication Data

US 2010/0317214 A1 Dec. 16, 2010

(51) Int. Cl.
*H01R 13/62* (2006.01)

(52) U.S. Cl. ..... 439/299; 439/924.2

(58) Field of Classification Search ..... 439/299, 439/347, 131, 157, 752, 924.2, 300
See application file for complete search history.

(56) References Cited

U.S. PATENT DOCUMENTS

| | | | | |
|---|---|---|---|---|
| 4,867,699 | A * | 9/1989 | Oda et al. | 439/355 |
| 5,017,147 | A * | 5/1991 | Sugiyama et al. | 439/144 |
| 5,876,226 | A | 3/1999 | Tsukakoshi et al. | 439/157 |
| 6,254,407 | B1 | 7/2001 | Burns | 439/157 |
| 6,364,704 | B1 | 4/2002 | Godefroy | 439/589 |
| 7,588,461 | B2 * | 9/2009 | Tyler | 439/607.41 |
| 2004/0121640 | A1 | 6/2004 | Okamoto et al. | 439/347 |

FOREIGN PATENT DOCUMENTS

| | | | |
|---|---|---|---|
| DE | 100 49 347 | A1 | 4/2001 |
| WO | WO 2008/109109 | A1 | 9/2008 |

* cited by examiner

*Primary Examiner* — Javaid Nasri
(74) *Attorney, Agent, or Firm* — Harrington & Smith

(57) ABSTRACT

The present relates to an electrical connector system which includes a first connector assembly having a first connector and a second connector to be coupled one to the other; a second connector assembly having a third connector and a housing contiguous to the first connector, the housing having an open connecting face for receiving within a complementary part of the third connector so as to perform a coupling one to the other. This connector system may include a movable element which is movable between two positions, i.e.: a "first position" in which it masks at least partially the open connecting face, so that it makes impossible the coupling with the third connector; a "second position" in which it does not mask the front open connecting face, so that it makes possible the coupling with the third connector; the movable element being able to be moved into the "second position" only when said first and second connectors are fully coupled together.

11 Claims, 3 Drawing Sheets

ELECTRICAL CONNECTOR SYSTEM WITH POWER AND COMMAND CONNECTORS

FIELD OF THE INVENTION

The present invention relates to an electrical connector system.

BACKGROUND OF THE INVENTION

It is known electrical connector systems comprising:

a first connector assembly having a first connector and a second connector to be coupled one to the other; and a second connector assembly having one connector (i.e. a third connector) or two connectors (i.e. a third connector and a fourth connector) to be coupled one to the other.

Each connector comprises a housing with terminals adapted to make electrical contact with complementary terminals of the complementary connector to be coupled with.

This type of electrical connector system may be used as a part of an overall electrical system for connecting an actuator to a power source and a control source. For example, the connector system may be used as a part of a power steering or an electrical brake of a motor vehicle, or a control system of an electrical traction motor of a hybrid vehicle, the said $1^{st}$ connector assembly being a power connector assembly and the said $2^{nd}$ connector assembly being a control connector assembly.

The terminals are mechanically and electrically connected to power, respectively control wires which are further connected to upstream or downstream apparatus.

During the coupling and uncoupling of the power connector assembly the contact resistance between the complementary terminals is momentarily higher than the prescribed value. Further during some time the extremities of the complementary terminals are at small enough a distance such a way that, if a voltage is applied, an electric arc flows. Those circumstances in combination with electrical current may cause a temperature rise and therefore damages of the connector system and failure of the upstream or downstream apparatus.

SUMMARY OF THE INVENTION

An object of the invention is to provide a connector system of the aforementioned type where the risk of damages is minimized.

To this end, the coupling of the power connector assembly can be secured, such a way that no or at least only low electrical current flows through the power connector assembly when this assembly is not completely coupled.

In many electrical systems, especially motor vehicle systems, when coupling the electrical connector system, a voltage is only applied at the power source to the power wires after the corresponding command wires have been connected to the command source. On the reverse, when disconnecting, the voltage is removed from the power wires as soon as the corresponding command wire or wires have been disconnected from the command source.

Accordingly, in a first aspect, the invention provides a connector system of the aforementioned type where coupling of the command connector assembly is only possible after the power connector assembly has been fully coupled.

In a second aspect the invention provides a connector system of the aforementioned type where uncoupling of the power connector assembly is only possible after the command connector assembly has been fully uncoupled.

From U.S. Pat. No. 6,254,407 an electrical connector system is known including a movable element or slider whose wings are slidable in corresponding channels provided in the second connector, wherein this system is arranged such that the slider is fully engaged in the second connector only when the first and second connectors are fully coupled together.

In an other aspect of the invention, the first connector and housing are arranged to be contiguous one to the other and the connector system further comprises a movable element which is movable between two positions.

BRIEF DESCRIPTION OF THE DRAWINGS

Other characteristics and advantages of the present invention will appear when reading the following detailed description made with reference to the accompanying drawing, in which.

DETAILED DESCRIPTION OF THE INVENTION

Figure 5:
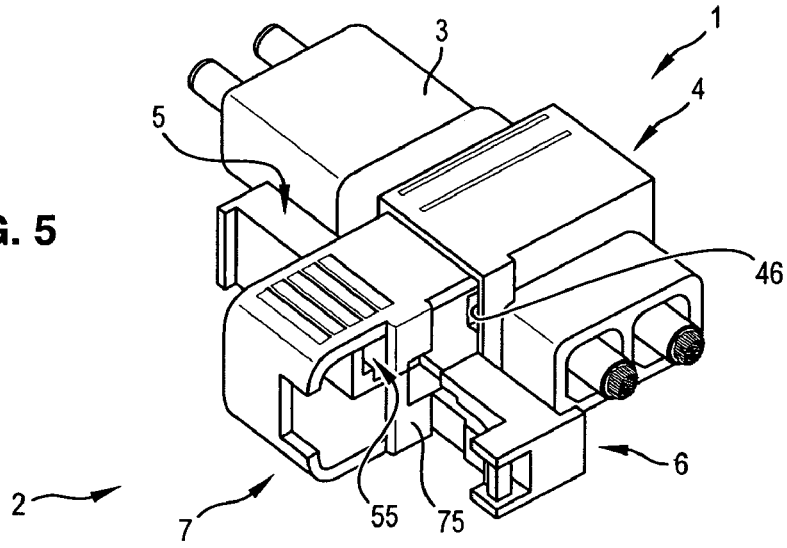
FIG. 5 is a perspective view of said connector system, the slider being in a "first position" which makes impossible the coupling of said housing and third connector.

In a first embodiment shown on FIG. 5, the electrical connector system according to the present invention comprises:

a first connector assembly 1, such as a power connector assembly, with a first connector 3 designed to be coupled with a corresponding second connector 4;

a second connector assembly 2, such as a control connector assembly, with a third connector 6 designed to be coupled with a corresponding housing 5.

The material from which these connectors are made can vary. But they are preferably made of plastics or other like insulating material.

The three connectors 3, 4, 6 and the housing 5 are approximately of parallelepiped shape.

The first connector 3 is sized and shaped to receive the second connector 4 so as to perform a coupling according to a first plugging axis.

The housing 5 is sized and shaped to receive the third connector 6 so as to perform an electrical coupling according to a second plugging axis.

In this embodiment, the housing 5 is a fourth connector, or second command connector, to be coupled with the third connector 6.

In another embodiment, not represented, the first connector 3 and the housing 5 are bound together into a single output connector, advantageously of unitary construction. In this other embodiment, the electrical connector system has therefore two input connectors and one output connector, adapted to be a termination for a single output cable bundle.

Coming back to the first embodiment, the first connector 3 and the housing 5 are further arranged to be contiguous one to the other. In particular they are advantageously adapted to be mounted together for having the first and second plugging axes parallel each other.

Figure 1:
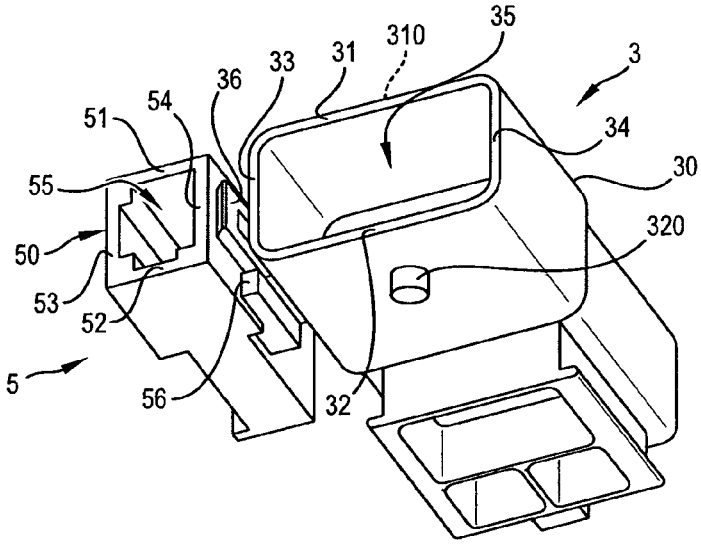
FIG. 1 is a perspective view of said first connector and housing.

With reference to FIG. 1, an example of such first connector 3 and housing 5 is shown.

The first connector 3 has a main body 30 with upper and lower parallel walls 31 and 32, and lateral parallel walls 33 and 34.

Numerals 310 and 320 identify upstanding projections extending from the external faces of walls 31 and 32 and integral with them. They extend generally perpendicularly with respect to these walls.

The front face 35 of the first connector 3 is open.

Figure 4:
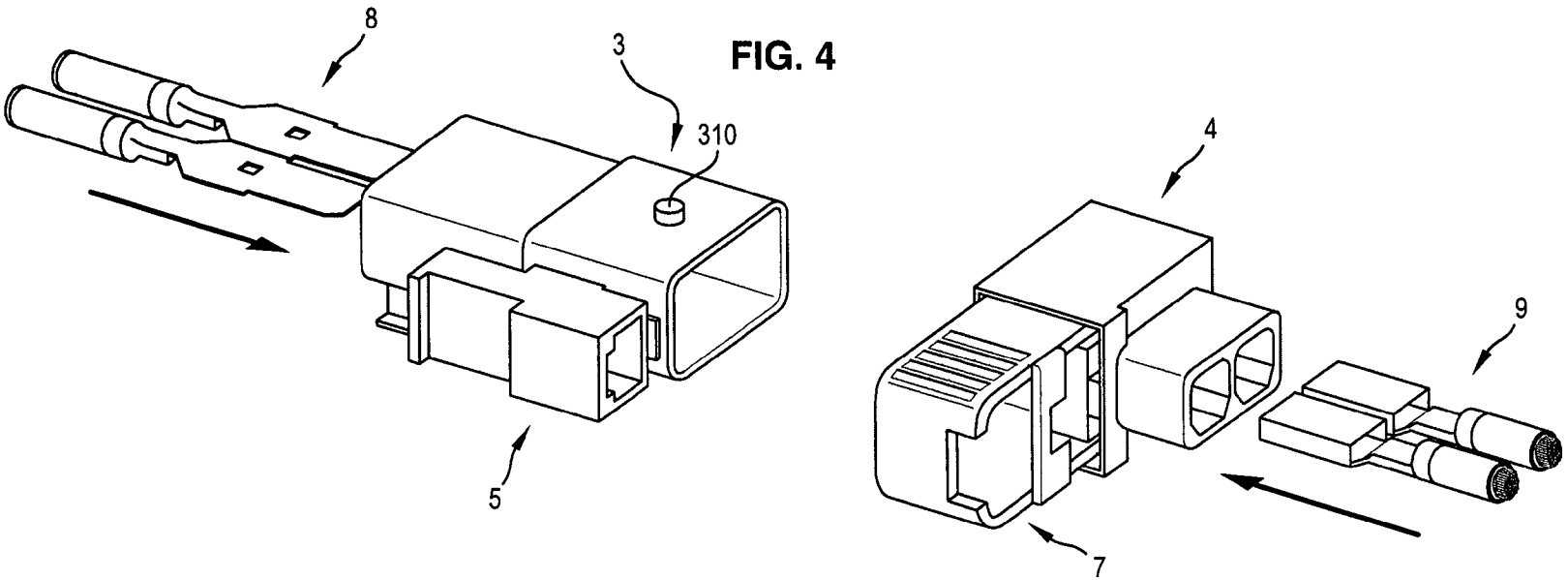
FIG. 4 is an exploded perspective view of said first and second connectors, and housing, together with electrical terminals to be received therein.

As shown on FIG. 4, the first connector 3 is arranged for receiving first electrical terminals 8 in a well known manner.

The back part of the first connector 3 is equipped with a grid (not shown). In a well known manner this grid has advantageously a TPA (Terminal Position Assurance) device (not shown), which makes that this grid cannot be pushed into its closed working position if any terminal is not correctly mounted in the connector, and which further prevents the coupling of the first and second connectors 3 and 4.

The housing 5 is fastened to said first connector 3. More precisely, the external face of the lateral wall 33 of the first connector 3 is provided with a longitudinal leg 36 which cooperates with a complementary slot 56 provided in the housing 5.

The housing 5 has also a main body 50, with upper and lower parallel walls 51 and 52, and lateral parallel walls 53 and 54.

Said slot 56 is integral with the lateral wall 54.

The housing 5 comprises an open connecting face 55 or front face. This front face 55 of the housing 5 is open and oriented in the same direction as the open face 35 of the first connector 3 once fastened together to the housing 5.

Consequently, the first connector 3 is contiguous to the housing 5 so as to have their respective plugging axes parallel to each other.

Figure 2:
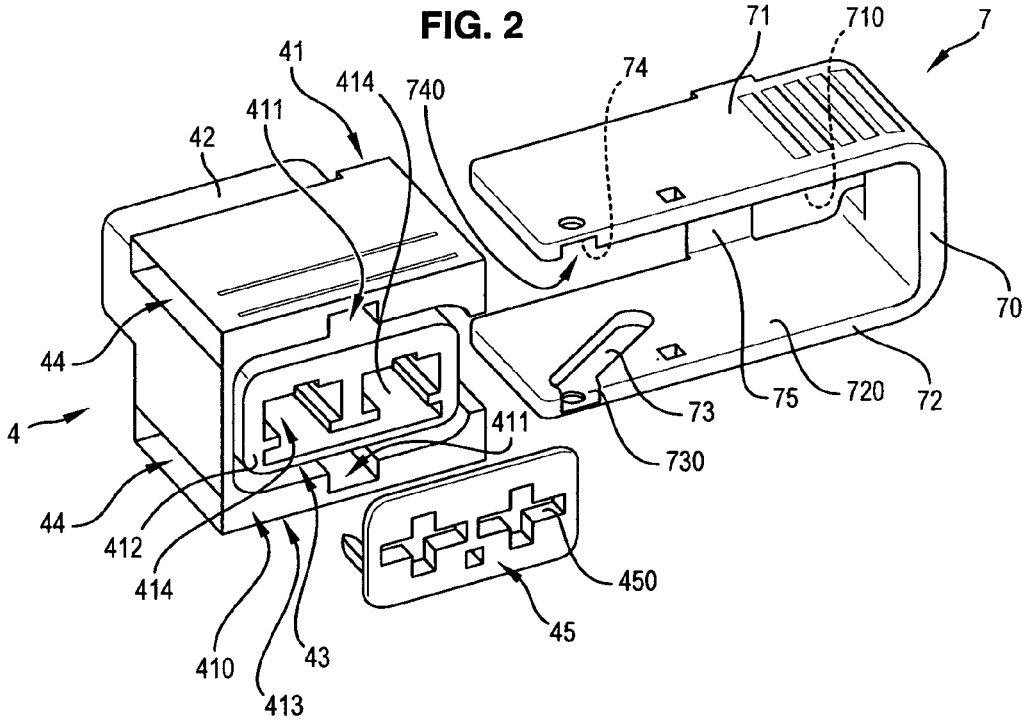
FIG. 2 is an exploded perspective view of said second connector, together with its slider.

The second connector 4, that is to say the second part of the power connector assembly 1, is depicted in FIG. 2.

It comprises a main body 41 and a rear portion 42 which receive second electrical terminals 9, as shown on FIGS. 4, and 5 to 7.

The main body 41 has a structure quite similar to the one described in U.S. Pat. No. 6,364,704, cited by reference.

This body 41 includes a central core 412 and a peripheral skirt 413, separated form each other by a groove 43.

The central core 412 comprises recesses 414, of a cross section suitable to receive said second electrical terminals 9.

The front face of the central core 412 receives a grid 45 with openings 450 suitable to allow the passage of the first terminals 8 which connect with the second terminals 9 inside the recesses 414. In a similar manner to first connector 3, grid 45 may advantageously have a TPA device, which further prevents the coupling of the first and second connectors 3 and 4 in case a terminal is not correctly mounted.

The peripheral skirt 413 is shaped and sized in a way suitable to accommodate with the walls 31 to 34 of the first connector 3 and to make possible an electrical contact between first and second terminals 8 and 9.

The upper and lower parts of the front face of the skirt 413 have each an opening 411 which respectively communicate with transversal channels 44 that are provided all along the upper and lower parts of the skirt 413.

The opposite ends of these channels 44 are opened on opposite lateral walls of the skirt 413.

The openings 411 are sized and positioned in such a way that when the first connector 3 is engaged into the groove 43 of the first connector 3, the projections 310 and 320 are respectively engaged into openings 411.

The second connector 4 is provided with control means such as a movable element 7, which is advantageously a slider.

In the present embodiment, this slider 7 has a generally U-shaped construction, with a base 70 and two parallel wings or sliding members 71 and 72.

These wings are sized in such a way that it is possible to introduce them, with limited clearance, into the transversal channels 44 of the skirt 413.

On the inner faces 710, 720 of wings 71 and 72 are provided with cam slots 73 and 74 which are directed obliquely relatively to the longitudinal axis of these wings.

Each cam slot 73-74 is opened at a side edge of its respective wing 71-72 via openings 730 and 740.

Openings 730 and 740, together with cam slots 73 and 74 are positioned and sized in such a way that it is possible to introduce projections 310 and 320 within.

First and second connectors 3 and 4 are coupled together in a well known manner by pushing on the slider 7, which allows to minimize the force required from the operator for coupling or uncoupling the first and second connectors.

Further the mechanical interaction through the cam slots and projections is such that the first and second connectors 3 and 4 can be coupled or uncoupled only with the corresponding movement of the slider.

As shown on the accompanying figures, the wings 71 and 72 of the slider 7 are also linked by a crosspiece 75. It extends from the side edges of the wings which are opposite from those in which openings 730 and 740 are formed. In other words, it extends in the rear portion 42 of connector 4.

This crosspiece 75 is U-shaped, having parallel wings turned in the direction of the wings 71 and 72 of the slider 7 and a notch opened toward connector body 41 (See FIG. 4).

The third connector 6 has a well known structure (See FIG. 5). It is sized and shaped in such a way that its main body 60 can be introduced in the housing 5, via its open front side 55, with full engagement.

Figure 3:
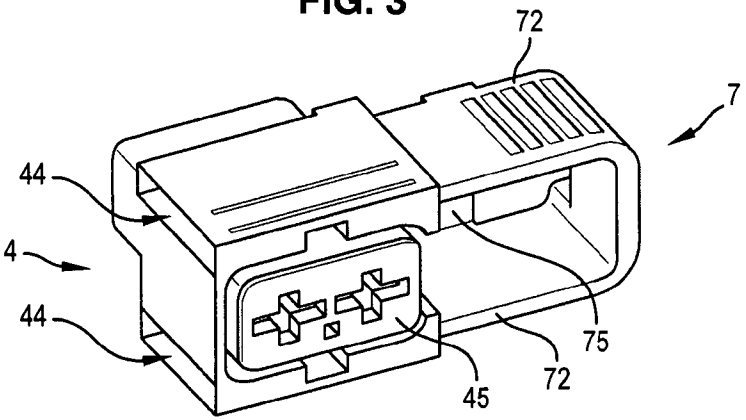
FIG. 3 is similar to FIG. 2, the slider being engaged into said second connector.

As shown on FIGS. 3, 4 and 5, prior to connection the slider 7 is in a first position relatively to the second connector 4. In this first position, the ends of its wings 71 and 72 engaged into channels 44 and its openings 730 and 740 respectively face the openings 411 of the skirt 413 of the body 41. Advantageously slider 7 is hold in this first position by a releasable indexing device, not represented.

When the first connector 3 is engaged into the groove 43 of the second connector 4, the projections 310 and 320 enter into the openings 411 of the body 41 and into the openings 730 and 740 of the slider 7.

Further, the slider 7 can be slid into the second connector 4, so that the projections 310 and 320 are driven into the slots 73 and 74 in the direction of their ends.

Figure 6:
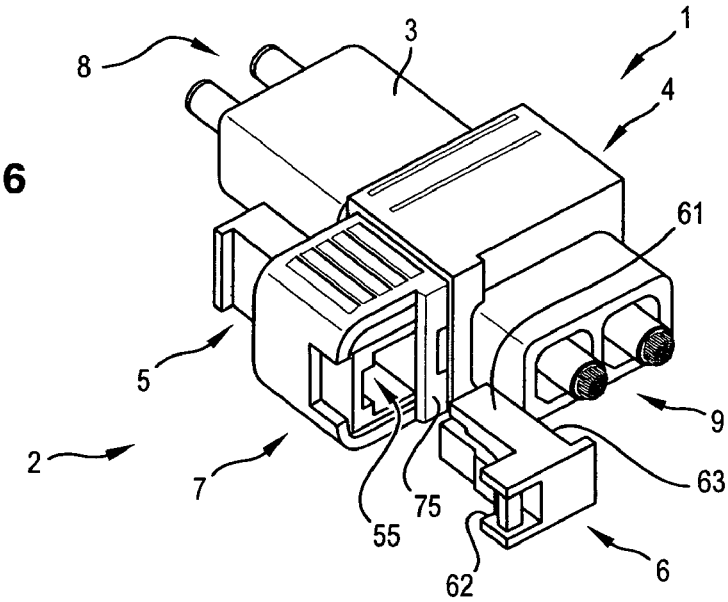
FIG. 6 is a view similar to FIG. 5, in which the slider is in a "second position"
Figure 7:
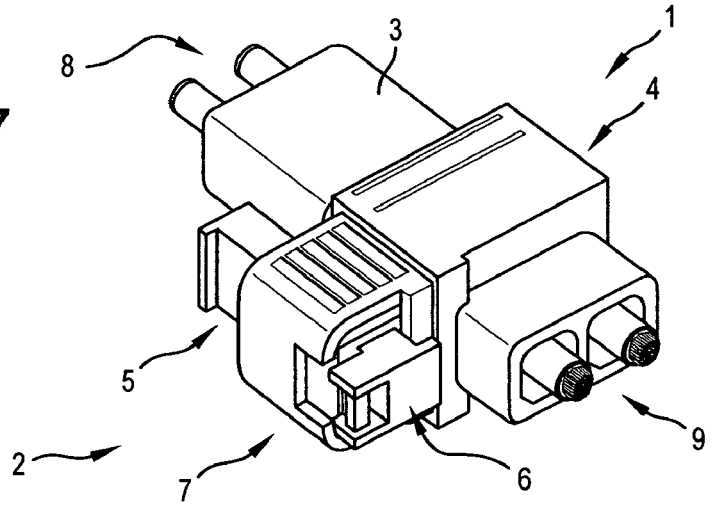
FIG. 7 is a view similar to FIG. 6, in which the housing and the third connector are fully mated.

Then the slider 7 is completely pushed in an end or second position, where the connectors 3 and 4 are in full engagement (position of FIGS. 6 and 7).

In this position, the parallel wings 71 and 72 and the base 70 of the slider 7 surrounds the housing 5.

The slider 7 and its crosspiece 75 are shaped and sized in such a way that when the sliding element is in its first position (FIG. 5), it masks at least partially the front open connecting face 55 of the housing 5, preventing any engagement of the third connector 6 with the housing 5.

More precisely, the crosspiece 75 is positioned in front of this open face 55.

As shown on 6, when pushing the slider 7 into its second position, the wings of the crosspiece 75 disappear at least partially into recesses 46 of the second connector 4, which allows the completion of the slider movement and clear the way through face 55. When the slider 7 has reached this second position, nothing masks the open connecting face 55 of the housing 5.

Consequently, it is possible to engage the third connector 6 into the housing 5. More precisely, a longitudinal main part 61 of connector 6 is mated in the housing 5.

At the end of this longitudinal main part 61 which is not engaged in the housing 5, a transversal extension is provided with a stop wall 62 facing the opening 55 of the housing 5 so as to abut against the wall 53 of the housing 5 once the main part 61 is completely engaged.

Moreover, the main part 61 is designed so as to have a lateral wall 63 abutting the back edge of the base of the U-shaped crosspiece 75, once the main part 61 is engaged into the housing 5. As a consequence, the movable element or slider 7 is able to be moved back from its second position into its first position only when the third connector 6 is fully uncoupled from the housing 5. Therefore it is possible to disconnect the power connector only when the third connector 6 is fully uncoupled from the housing 5.

Thanks to this connector system, it is possible to couple a control connector assembly, only if the connectors 3, 4 of the power connector assembly 2 are in full engagement. Furthermore, the power connector assembly cannot be disconnected if the connectors of the control connector assembly are not unmated.

In the above description, the slider 7 is U-shaped. In another non described embodiment, this element could have another shape. For example, it can have the form of a single plate, with an opening for the engagement of the connector 6, when it is in the second position.

The invention claimed is:

1. An electrical connector system which comprises:

a first connector assembly having a first connector and a second connector to be electrically coupled to each other;

a second connector assembly having a third connector and a housing, the housing being adapted for receiving a complementary part of the third connector so as to perform a coupling of the complementary part to the housing;

the electrical connector system further comprises a movable element movable between a first position and a second position, the movement of said movable element between said first and second positions allowing to minimize the force required from an operator for coupling the first and second connectors, wherein the movable element is configured, in the first position, to prevent the coupling of the third connector and the housing, and wherein the movable element is configured, in the second position, to prevent uncoupling of the first connector and the second connector, wherein the housing is contiguous to the first connector and comprises an open connecting face and wherein in the first position of the movable element, the movable element masks at least partially the open connecting face so as to prevent engagement of the third connector into the housing, and wherein in the second position of the movable element the front open connecting face is cleared to allow engagement of the third connector into the housing.

2. An electrical connector system according to claim 1 further comprising control means including the movable element, wherein the control means are adapted to prevent the coupling of the second connector assembly if the first connector assembly is not coupled and to prevent uncoupling of the first connector assembly if the second connector assembly is coupled.

3. An electrical connector system according to claim 1 wherein the movable element is able to be moved from its second position into its first position only when the third connector is fully uncoupled.

4. The electrical connector system according to claim 1, wherein said movable element and said first and second connectors comprise cooperating members which allow said movable element to be in its second position only when said first and second connectors are fully coupled together and to be in its first position only when said first and second connectors are fully uncoupled.

5. The electrical connector system according to claim 1, wherein said movable element is a slider having parallel wings that can be received and slid in respective channels formed between opposite walls of said second connector, the housing being contiguous to one of the opposite walls, so that the movable element surrounds said housing once in the second position.

6. The electrical connector system according to claim 1, wherein said movable element further comprises a crosspiece extending between wings which is arranged for masking at least partially the front open face of said housing, when in the first position.

7. The electrical connector system according to claim 6, wherein when said movable element is in the second position, and said third connector is coupled to said housing, third connector is arranged for abutting against said crosspiece, so that it is impossible to move the movable element from said second position.

8. The electrical connector system according to claim 1, wherein the second connector and said housing are arranged to be contiguous such that a plugging axis along which the first and second connectors are coupled together is substantially parallel to the plugging axis along which the housing and third connector are coupled together.

9. An electrical connector system according to claim 1, wherein said movable element is movable between the first position and the second position by a translatory motion.

10. An electrical connector system according to claim 1, wherein the housing is fastened to the first connector, and wherein said movable element surrounds said housing when in the second position.

11. An electrical connector system which comprises:

a power connector assembly comprising:

a first insulating connector carrying at least one projection, and a second insulating connector to be coupled with the first connector along a first plugging axis;

a command connector assembly comprising:

a third insulating connector;

an insulating housing having an open connecting face for receiving within a complementary part of the third connector so as to perform a coupling to each other along a second plugging axis, and the first connector and housing being fastenable contiguously so as to have the first and second plugging axes substantially parallel to each other once mounted together;

a slider which is slidable in the second connector between two opposite positions comprising:

a "first position" in which the slider masks at least partially the open connecting face to prevent coupling of the housing with the third connector;

a "second position" in which the slider does not mask the front open connecting face to allow coupling of the housing with the third connector;

the slider comprising a cam slot cooperating with the projection(s) of the first connector so as to allow the slider being in the second position only when said first and second connectors are fully coupled together.

* * * * *